US005525769A

United States Patent [19]

Anderson

[11] Patent Number: 5,525,769

[45] Date of Patent: Jun. 11, 1996

[54] INVERTER CUT-OUT SWITCH

[75] Inventor: Larry G. Anderson, Erie, Pa.

[73] Assignee: General Electric Company, Erie, Pa.

[21] Appl. No.: 242,770

[22] Filed: May 16, 1994

[51] Int. Cl.[6] ..... H01H 1/54; H01H 1/32

[52] U.S. Cl. ..... 200/1 R; 200/17 R; 218/12; 335/196

[58] Field of Search ..... 200/1 R, 1 V, 200/5 R, 16 R, 16 A, 16 C, 16 E, 17 R, 18, 50 R, 50 B, 50 C, 51 R, 51.02–51.06, 51.13, 253.1, 258; 218/12, 45, 67, 75, 80, 100; 335/196–204

[56] References Cited

U.S. PATENT DOCUMENTS

| | | | |
|---|---|---|---|
| 3,290,471 | 12/1966 | Gerardin et al. | 200/572 |
| 3,323,018 | 8/1964 | Roth | 317/60 |
| 3,610,858 | 10/1971 | Mannheim-Seckenheim et al. | 200/48 R |
| 3,805,200 | 4/1974 | Suzuki | 335/201 |
| 3,887,888 | 6/1975 | Bayles et al. | 335/195 |
| 4,594,532 | 6/1986 | Edlin et al. | 315/331 |
| 5,041,808 | 8/1991 | Erickson | 337/156 |
| 5,197,604 | 3/1993 | Jedlitschka et al. | 200/572 |

FOREIGN PATENT DOCUMENTS

| | | | |
|---|---|---|---|
| 2279215 | 2/1976 | France | H01H 31/00 |
| 2190545 | 11/1987 | United Kingdom | H01R 4/48 |

*Primary Examiner*—Kristine L. Kincaid
*Assistant Examiner*—Michael A. Friedhofer
*Attorney, Agent, or Firm*—Jill M. Breedlove; Marvin Snyder

[57] ABSTRACT

An inverter contact switch has a first pair of spaced fixed contacts connected to respective terminals of an inverter circuit for selectively disconnecting and connecting the inverter to a DC power bus. A first pair of spaced movable contacts are positioned on opposite sides of the fixed contacts. A drive actuator is coupled to the movable contacts for concurrently driving the movable contacts into substantially simultaneous engagement with the pair of fixed contacts for establishing a circuit path from one of the fixed contacts through each of the movable contacts to another of the fixed contacts. The switch may include a second pair of fixed and movable contacts operatively connected to a DC return bus and another terminal of the inverter for isolating the inverter from both the power and return buses. The switch also includes flux concentrators positioned adjacent the fixed contacts for concentrating electromagnetic flux generated by current through the closed contacts so as to counteract repulsive forces at the contact interfaces due to very large inverter currents.

6 Claims, 7 Drawing Sheets

INVERTER CUT-OUT SWITCH

BACKGROUND OF THE INVENTION

The present invention relates to electrical switches and, more particularly, to an electromagnetic bi-stable switch using fault current induced electromagnetic force to maintain switch closure.

In electrical control systems for electric motor powered vehicles such as locomotives, it is common to utilize electric power isolation switches to carry very large fault currents, e.g., currents in the range of 100,000 amperes. In stationary applications, large mechanical disconnect switches (i.e., knife switches) can be utilized for this purpose. However, in transportation applications, such as locomotives, transit cars or off-highway vehicles, such isolation or disconnect switches are required to be small in size and lightweight. Furthermore, the breaker must have a relatively long life cycle, e.g., 20,000 cycles without replacement. These switches are distinct from circuit breakers in that they are designed to maintain contact closure for very large currents whereas circuit breakers are generally designed to open under high current conditions.

One problem with such high-current switches is that current constriction at a contact can generate very high separation forces on a closed contact. For example, 100,000 amperes can generate about 2244 pounds of force on a single butt contact. Accordingly, it is desirable to provide a relatively small isolation switch that can withstand very large currents and can be cycled repetitively.

SUMMARY OF THE INVENTION

It is an object of the present invention to provide a relatively small and lightweight contact or assembly or switch which can remain closed under high current conditions. In a preferred embodiment a contactor assembly, or inverter cut-out switch, has a first pair of spaced fixed contacts connected to respective terminals of a circuit, such as an inverter, to be selectively connected and disconnected from a DC or AC power bus. A first pair of spaced movable contacts are positioned on opposite sides of the fixed contacts, and a drive actuator is coupled to the movable contacts for concurrently driving the movable contacts into substantially simultaneous engagement with the pair of fixed contacts for establishing a circuit path from one of the fixed contacts through each of the movable contacts to another of the fixed contacts. Flux concentration means is positioned adjacent the pair of fixed contacts for concentrating electromagnetic flux generated by current through the fixed and movable contacts when the movable contacts are engaged with the fixed contacts. In one form, the flux concentration means comprises a pair of magnetically permeable members aligned generally parallel with the fixed contacts and electrically insulated therefrom.

The fixed and movable contacts are each desirably formed with mating tapered contact surfaces for minimizing the force required for positive engagement. Each contact surface is also precious metal plated for improved electrical characteristics and is arcuately shaped so as to be self-aligning. The movable contacts are supported on a pair of insulative support members coupled to the drive actuator for moving the movable contacts between engaging and non-engaging association with the fixed contacts. Springs are positioned between the movable contacts and the support for compensating for wear of the contacts.

In one form, the drive actuator comprises an electric motor, a gear assembly coupled in driving relationship with the motor, and a telescoping drive member coupled to each of the pair of insulative support members for driving the support members between engaging and non-engaging positions of the pair of movable contacts upon energization of the motor.

Preferably, the inverter cut-out switch assembly includes a second pair of fixed contacts laterally spaced from the first pair of fixed contacts and further includes a second pair of movable contacts mounted on the pair of insulative support members for engaging the second pair of fixed contacts upon energization of the motor. A pair of spaced guide rods support the pair of insulative support members in aligned relationship with the pairs of fixed contacts. Springs mounted on each of the guide rods in abutting relation with the insulative support members urge the support members in a direction of engagement of the movable contacts with the fixed contacts. In this form, the inverter cut-out switch assembly includes a pair of magnetically permeable bars positioned adjacent each of the pairs of fixed contacts on opposite sides of the contactor assembly and a magnetically permeable block positioned between the pairs of fixed contacts centrally of said assembly. The bars and block function to concentrate electromagnetic flux generated at the movable contacts by current passing therethrough.

BRIEF DESCRIPTION OF THE DRAWINGS

For a better understanding of the present invention, reference may be had to the following detailed description taken in conjunction with the accompanying drawings in which.

DETAILED DESCRIPTION OF THE INVENTION

Figure 1:
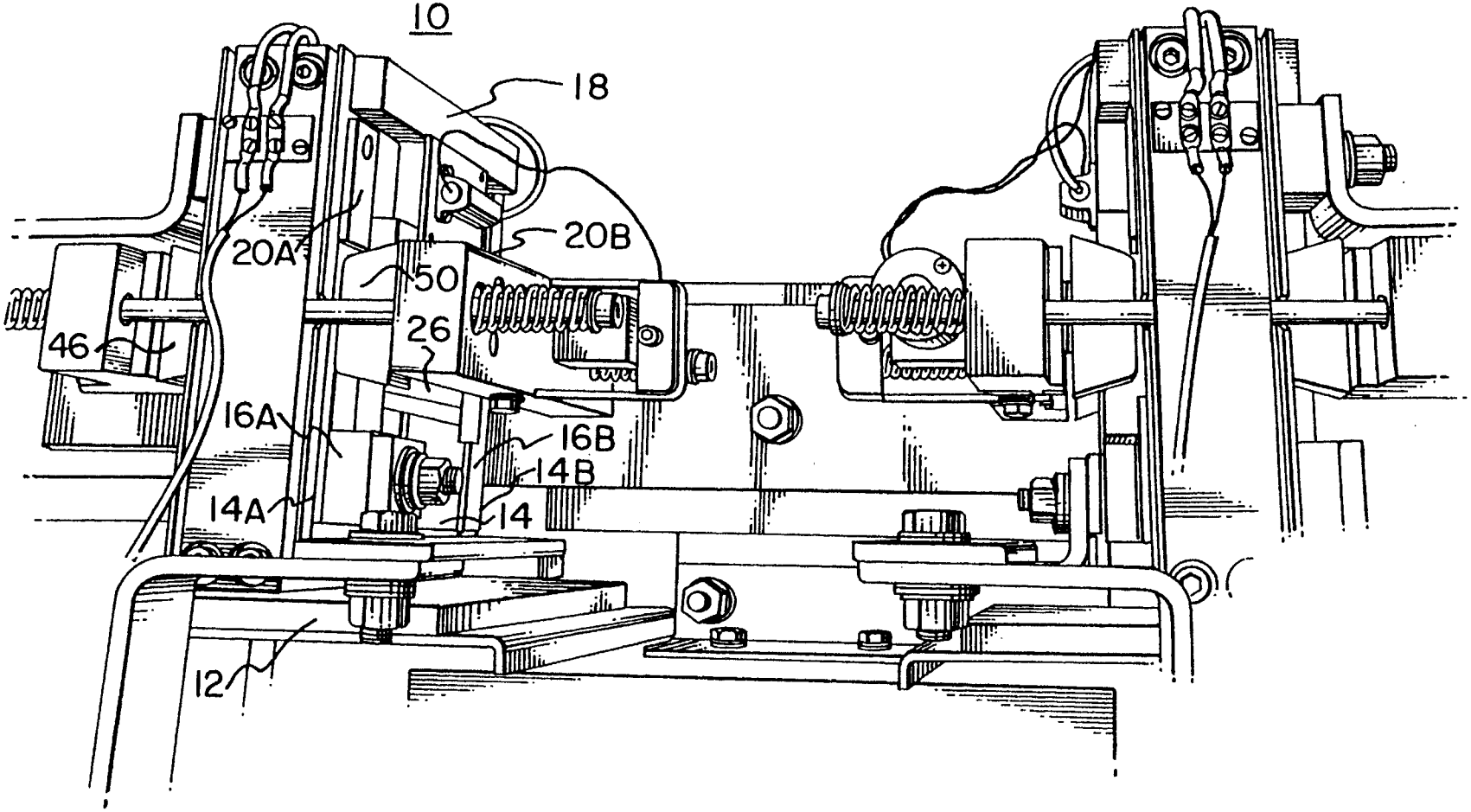
FIG. 1 is a perspective view of a inverter cut-out switch in accordance with the present invention.

Referring to FIGS. 1–8 in general and in particular to FIG. 1, there is shown a perspective view of an inverter cut-out (ICO) switch 10 in accordance with the present invention designed to operate over a temperature range of between about −40° C. and +65° C. Switch 10 is referred to as an ICO switch although it can be used in other high current applications.

Figure 2:
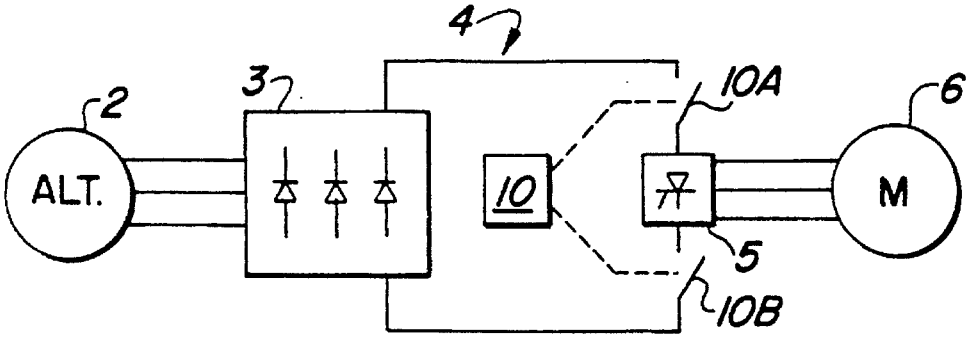
FIG. 2 is an electrical circuit diagram of a power controlled system for an electrically powered vehicle illustrating one application of the inverter cut-out switch of FIG. 1.

Referring briefly to FIG. 2, an electrical propulsion system for a locomotive includes an internal combustion engine (not shown) operated at constant speed to drive an alternator 2. A main rectifier 3 converts the alternating current (AC) from the alternator to direct current (DC) on a DC link 4. An inverter 5 is coupled to the DC link by an ICO switch 10 with contacts marked 10A and 10B. The inverter 5 provides controlled frequency power to an AC traction motor 6 for propelling the locomotive. In a typical system, there may be a multiplicity of traction motors, each coupled to an inverter tied to the DC link. Fault currents may be caused by device failure in an inverter and draw a very large current. The ICO switch 10 is designed to handle up to 100,000 amps of fault current.

Figure 3:
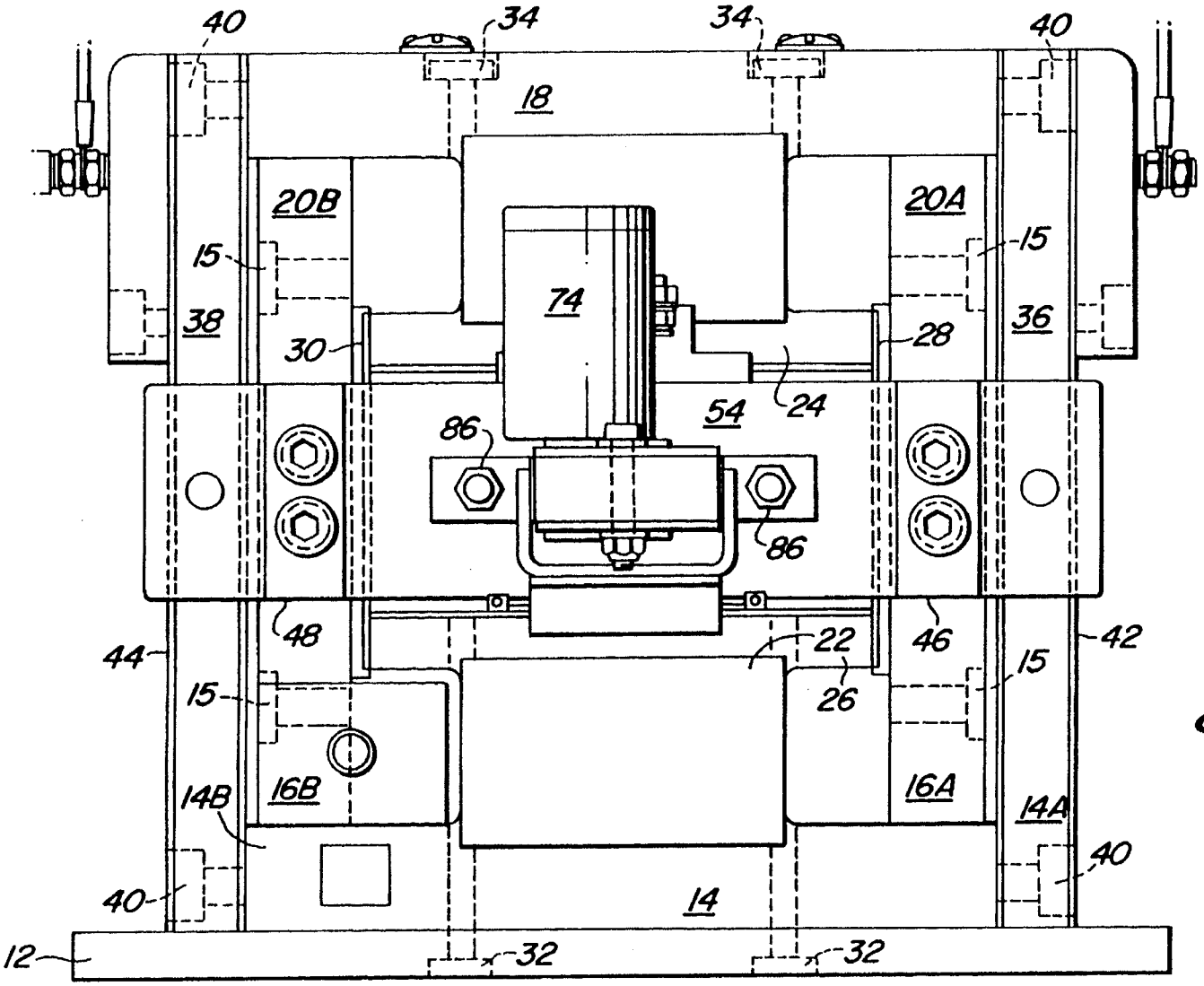
FIG. 3 is a motor side view of the switch of FIG. 1.

Referring to FIGS. 1 and 3, the contactor assembly or ICO switch 10 includes a base 12 of insulative material such as polyglass, a mixture of polyester and fiberglass. Base 12 is essentially a flat plate on which is mounted a lower insulative support 14. A pair of lower fixed contacts 16A, 16B are positioned on opposite ends 14A, 14B, respectively, of support 14. The contacts 16A, 16B are held in a fixed position by bolts or screws 15 passing through the contacts and threadedly engaging Helicoils or similar inserts in holes in the support 14. Positioned directly above and aligned with the lower support 14 is an upper support 18 having substantially the same configuration as the lower support 14. Another pair of fixed contacts 20A, 20B are attached to the upper support 18 in the same manner as contacts 16 to support 14. The contacts 20A, 20B are positioned directly above contacts 16A, 16B, respectively, forming a pair of laterally spaced apart fixed contact assemblies of contacts 16A, 20A and contacts 16B, 20B.

The lower support 14 and the upper support 18 include central portions 22 and 24, respectively, extending toward each other. A block 26 of magnetically permeable material, such as iron, is positioned between the portions 22 and 24. The block 26 establishes a fixed spacing between supports 14 and 18 and extends laterally toward each of the fixed contacts. A pair of electrically insulative plates 28 and 30 are placed between each side of the block 26 and an adjacent pair of the fixed contacts so as to electrically insulate the block from the contacts. The assembly of upper support 18, lower support 14, block 26 and base 12 is held together by through-bolts 32 extending from the bottom of base 12 through the assembly to the top of upper support 18. The bolts 32 may be retained by nuts 34 or the holes in upper support 18 may be threaded and filled with a threaded insert (not shown).

The contactor assembly or switch 10 also includes electrically insulative side members 36 and 38 overlaying the fixed contacts 16 and 20 and extending into overlaying relationship with upper and lower supports 18 and 14. The members 36 and 38 are attached to supports 14,18 by screws or bolts 40. Flat magnetically permeable plates 42 and 44 of iron, for example, are attached to the outside surfaces of each of the members 36 and 38, respectively. The plates 42, 44 and block 26 function to concentrate the electromagnetic flux generated by current through the contacts. The dimensions of block 26 and side members 36, 38 are selected to optimize the magnetic flux pattern generated by current through the switch contacts to produce sufficient attractive force between the movable contacts to cancel the repulsive forces generated at the fixed and movable contact interfaces and the torque generated by the electromagnetic fields of the contacts at opposite sides of the switch.

Figure 4:
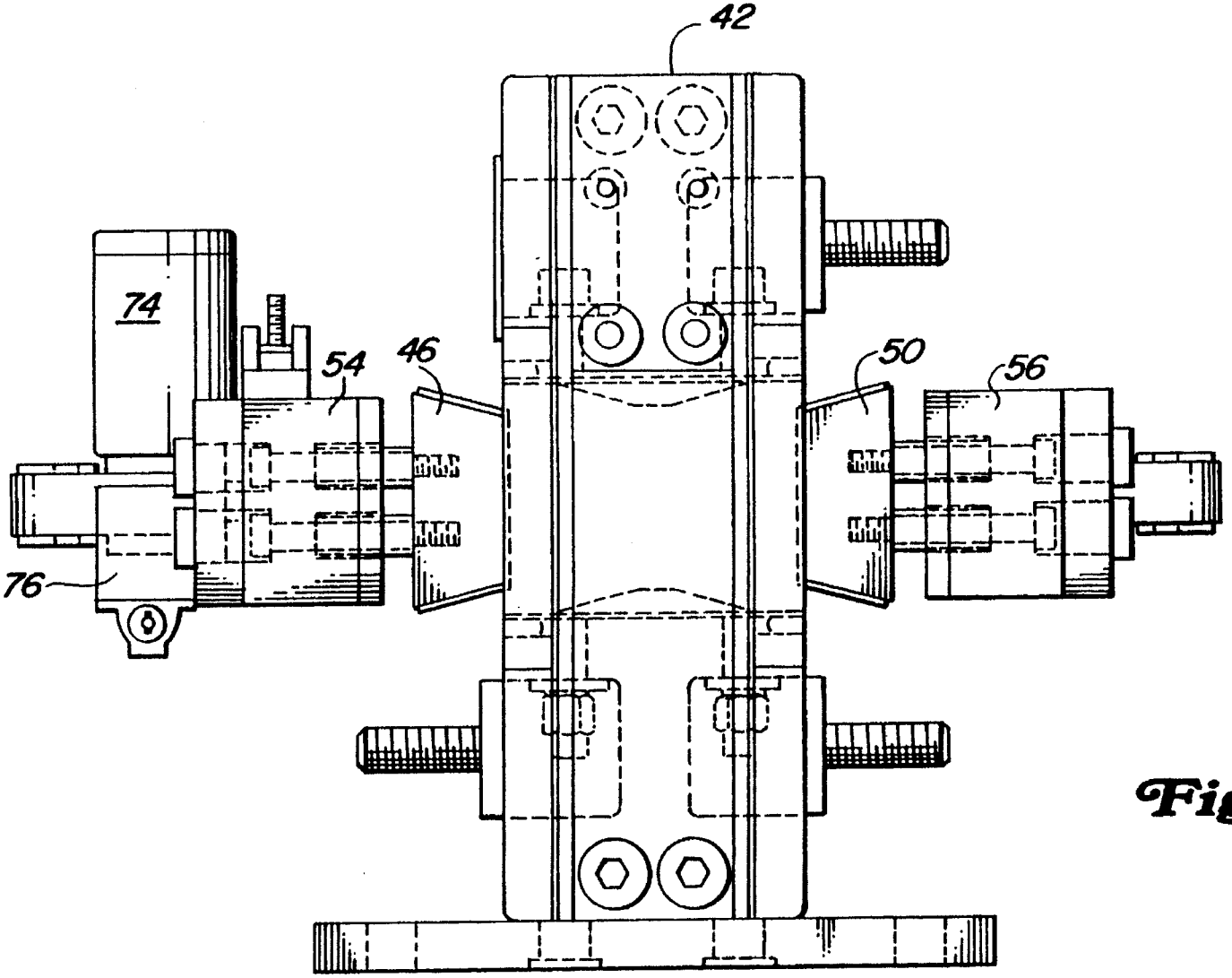
FIG. 4 is a partial sectional view of the right side of the switch of FIG. 1 showing the movable contacts in an open position.
Figure 5:
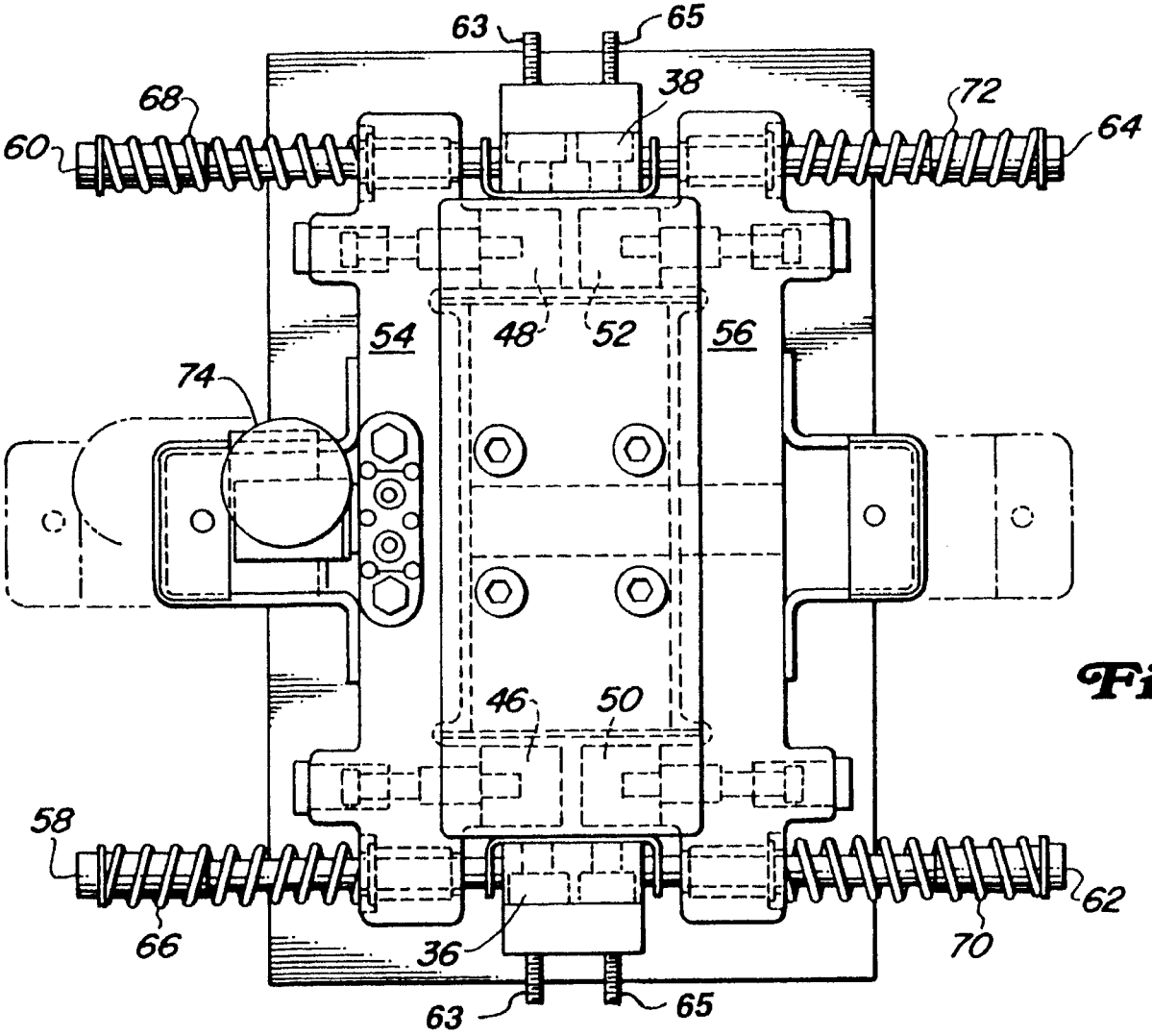
FIG. 5 is a top plan view of the switch of FIG. 1.

Considering FIG. 3 in conjunction with FIGS. 4 and 5, the latter views being edge and top views, respectively, contact closure is affected by movable contacts 46,48,50 and 52. Contacts 46 and 48 are mounted on opposite ends of a contact support member 54, while contacts 50 and 52 are mounted on opposite ends of a contact support member 56. The support members 54 and 56 are positioned directly opposite each other on opposing sides of the assembly 10. Each of the support members 54,56 are supported on respective pairs of guide rods 58, 60 and 62,64. The guide rods 58–64 are preferably shoulder bolts passing through holes in members 54,56 and threaded into corresponding threaded holes in side members 36,38. Coil springs 66, 68, 70 and 72 are placed about respective ones of the rods 58–64 to create a force on each end of the support members 54,56 so that they move uniformly toward the fixed contacts of the assembly 10, thereby eliminating or damping motion of support 54, 56 due to vibration when the switch is in the open state. FIG. 5 also shows the dual sets of terminal strips 63, 65 for coupling control power to motor 74. Both strips 63, 65 have common terminals so that the switch can be mounted in two separate orientations without having to rewire the switch in order to reach the control terminals.

Figure 6:
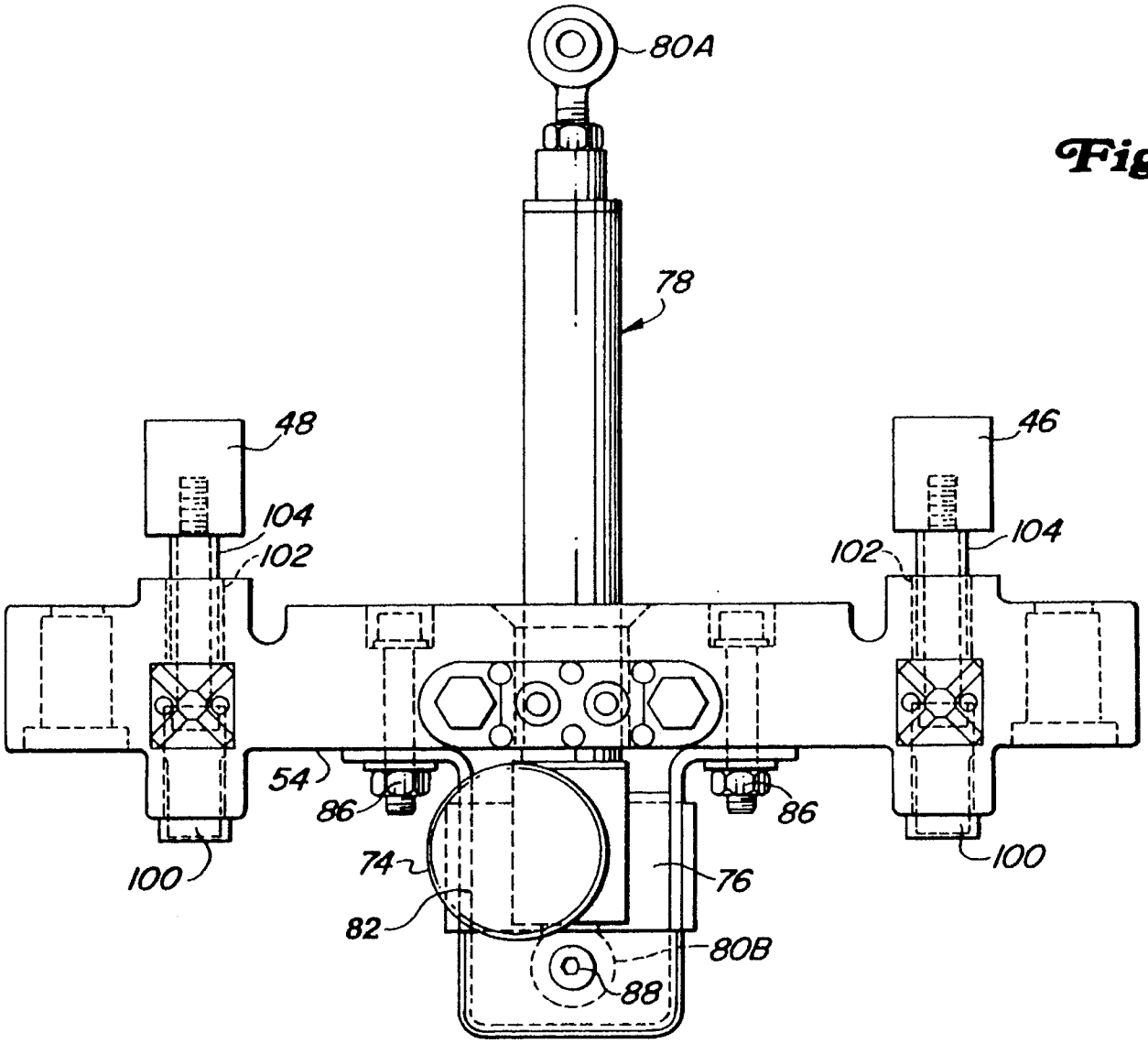
FIG. 6 is an illustration of a motor actuator for controlling contact position for the switch of FIG. 6.
Figure 7:
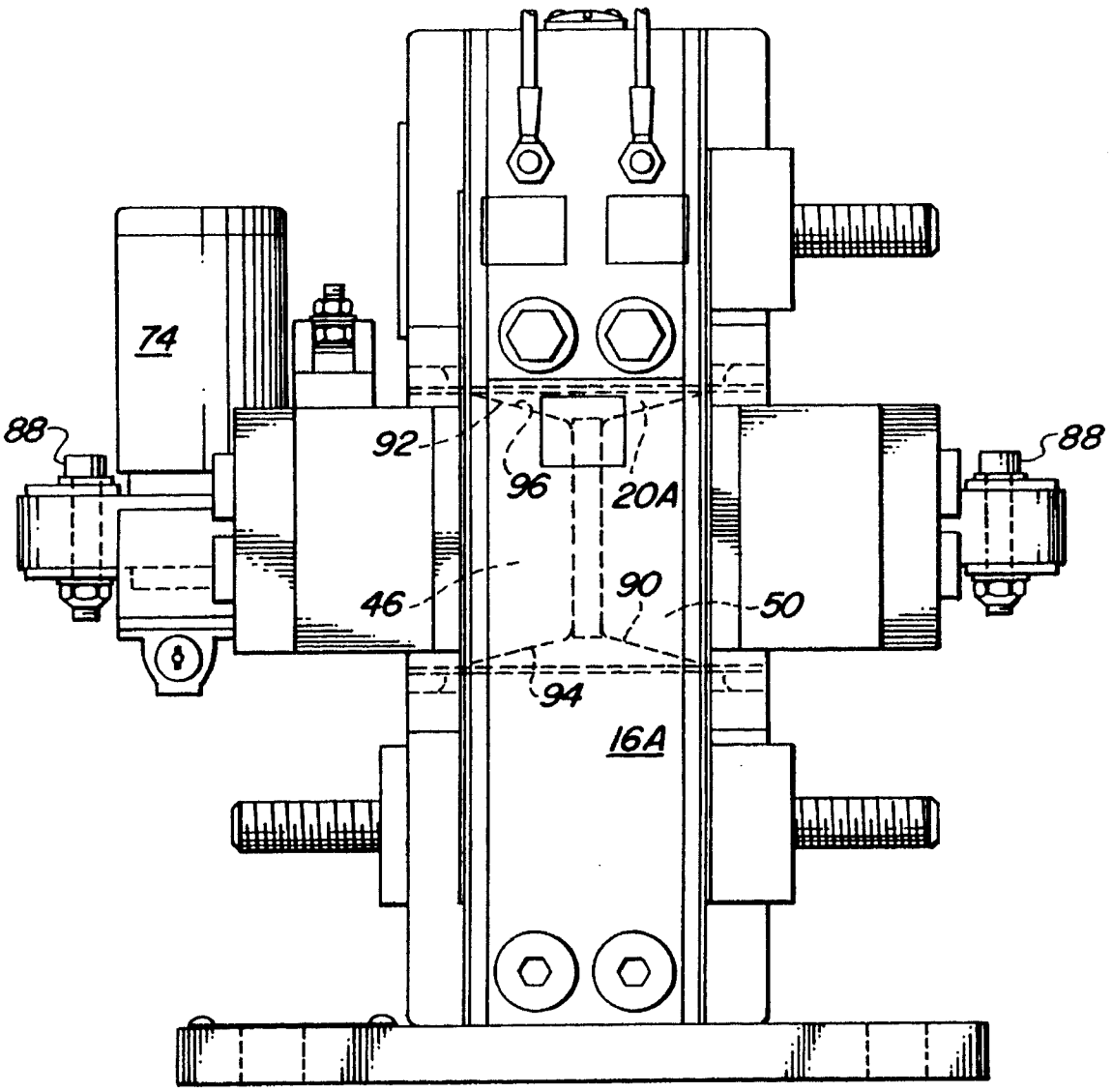
FIG. 7 is a right side view of the switch of FIG. 1 with the movable contacts in a closed position.

The support members 54,56 carrying the contacts 46–52 are moved between a contact engaging position and a contact non-engaging position by an electric drive motor 74 connected to a gear box 76 for driving at telescoping drive member linear actuator 78 as shown in FIG. 6. The motor 74, gear box 76 and actuator 78 are part of a commercially available drive unit commonly referred to as a ball drive actuator available from Motion Systems Corp. Each end of actuator 78 terminates in a respective connector 80A, 80B. Brackets 82 are mounted on respective ones of the support members 54,56 by screws/bolts 86. The actuator ends with connectors 80 passing through holes in the center of each of the support members 54,56; and the connectors 80 are attached to the brackets 82 by fasteners 88. The actuator 78 also passes through a center hole in the block 26. Appropriate electrical insulation, such as a bushing or sleeve, is placed in the hole through block 26 or about the actuator 78 to electrically isolate the actuator from block 26. The ball drive actuator has the advantage of allowing the motor to free-wheel through an overrunning clutch mechanism at each extreme of travel of actuator 78. This ability eliminates the need for limit or position switches and allows the motor 74 to be controlled by a timed actuation power pulse. For example, the motor 74 can be controlled by applying power for 30 seconds even though the actual actuation time or travel time to open or close the contacts may be only 7–10 seconds. FIG. 7 is a side view of the contactor assembly 10 with the movable contacts 46–52 in the engaging position with the fixed contacts 16 and 20. Movable contacts 46 and 50 are shown in phantom lines engaging fixed contacts 16A and 20A, also shown in phantom. Upper contact 20A and lower contact 16A are provided with angled or tapered contact surfaces as indicated at 90 and 92, where 90 is the surface on contact 16A and 92 is the surface on contact 20A. Movable contacts 46–52 are formed with mating tapered surfaces as indicated at 94 and 96. Preferably, the tapered angle for the contact surfaces is about 15° with respect to the direction of closure of the contacts as shown. The 15° angle provides higher contact force than a butt contact (90°) and counteracts the repulsive force created by current through the closed contacts. The movable contacts essentially form a wedge that can be driven into engagement with the fixed contacts. It is also desirable to provide a precious metal surface on the movable contacts 46–52 such as by welding or brazing a silver contact surface or inlay on the contact. The surfaces of the movable contacts are radiused or arcuately shaped to improve contact mating which would be difficult to achieve with flat contacts due to misalignment of contacts from assembly tolerance. The movable contacts are essentially self-aligning on the fixed contacts.

Figure 8:
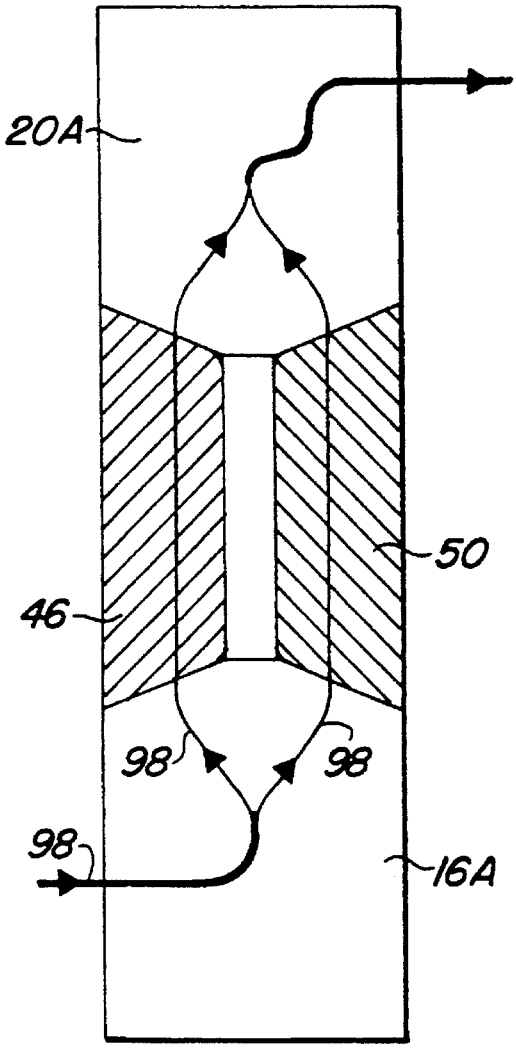
FIG. 8 is a diagram of the movable and fixed contacts of the switch of FIG. 1 showing current distribution through the switch contacts.

Referring to FIG. 8, one reason for providing dual movable contacts is to obtain current division through the contact assembly as indicated by arrows 98 so that the electromagnetic field generated by the current creates an attractive force between the movable contacts 46 and 50 sufficient to overcome the repulsive force at the contact interface at surfaces 90 and 94 or surfaces 92 and 96. For a current in the range of 100,000 amperes, the repulsive force at each contact surface can exceed 500 pounds. A counteracting attractive force between the movable contacts can prevent contact blow-out due to such current without requiring a positive locking mechanism on the contact assembly. There is also a torque generated on the contacts 46, 50 by current through contacts 48, 52 and vice versa. The block 26 and members 36, 38 concentrate flux to counteract the repulsive force and torque.

Referring again to FIG. 6, the movable contacts 46, 48, 50, 52 are coupled to contact support members 54 and 56, respectively, by screws 100 o At the surface adjacent the contacts 46, 50, the members 54, 56 have countersunk holes at 102 for receiving coil springs 104. The springs 104 extend above the surface of members 54, 56 and the screws 100 are sized such that without compressing contacts 46, 50 to members 54, 56, there is about a 0.25 inch gap between the members 54, 56 and the respective contacts 46, 50. At normal contact engagement, this gap is compressed to about 0.125 inch. As the contact surfaces wear, the gap can increase up to 0.25 inch before the contacts need be replaced. Accordingly, the springs 104 accommodate contact wear.

While the invention has been described in what is presently considered to be a preferred embodiment, many variations and modifications will become apparent to those skilled in the art. Accordingly, it is intended that the invention not be limited to the specific illustrative embodiment but be interpreted within the full spirit and scope of the appended claims.

What is claimed is:

1. A contactor assembly comprising:

a first pair of spaced fixed contacts connected to respective terminals of a circuit to be selectively opened and closed, said fixed contacts having a pair of tapered contact surfaces;

a first pair of spaced movable contacts positioned on opposite sides of said fixed contacts, said movable contacts having tapered contact surfaces corresponding to the tapered surfaces on said fixed contacts for mating engagement therewith;

drive means coupled to said movable contacts by a pair of insulative support members for concurrently driving said movable contacts into substantially simultaneous engagement with said pair of fixed contacts for establishing a circuit path from one of said fixed contacts through each of said movable contacts to another of said fixed contacts, said drive means comprising an electric motor, a gear assembly coupled in driving relationship with said motor, and a telescoping drive member coupled to each of said pair of insulative support members for driving said support members between engaging and non-engaging positions of said pair of movable contacts upon energization of said motor;

spring members for mounting said movable contacts to said support members, said spring members being at least partially compressed during engagement of said movable contacts with said fixed contacts for compensating for wear of said movable and fined contacts;

a second pair of fixed contacts laterally spaced from said first pair of fixed contacts and further including a second pair of movable contacts mounted on said pair of insulative support members for engaging said second pair of fixed contacts upon energization of said motor; and a pair of spaced guide rods for supporting said pair of insulative support members in aligned relationship with said first and second pairs of fixed contacts, and springs mounted on each of said guide rods in abutting relation with said insulative support members for urging said support members in a direction of engagement of said movable contacts with said fixed contacts.

2. The contactor assembly of claim 1 including means positioned adjacent said first and second pairs of fixed contacts for concentrating electromagnetic flux generated by current through said fixed and movable contacts when said movable contacts are engaged with said fixed contacts.

3. The contactor assembly of claim 2 wherein said means for concentrating electromagnetic flux comprises a pair of magnetically permeable members aligned generally parallel with said fixed contacts and electrically insulated therefrom.

4. The contactor assembly of claim 1 including a pair of magnetically permeable bars positioned adjacent each of said first and second pairs of fixed contacts on opposite sides of said contactor assembly and a magnetically permeable block positioned between said first and second pairs of fixed contacts centrally of said assembly, said bars and block functioning to concentrate electromagnetic flux generated at said movable contacts by current passing therethrough upon engagement of said movable contacts.

5. The contactor assembly of claim 4 including a precious metal contact surface formed on each contact surface of each of said movable contacts.

6. The contactor assembly of claim 4 wherein each of said contact surfaces of said movable contacts are arcuately shaped to establish a self-aligning position with said fixed contacts.

* * * * *